US005509205A

United States Patent [19]

Ragland, III

[11] Patent Number: 5,509,205

[45] Date of Patent: Apr. 23, 1996

[54] UTILITY KNIFE HAVING BLADE RETENTION FEATURE

[75] Inventor: Nicholas Ragland, III, Cincinnati, Ohio

[73] Assignee: Millers Falls Tool Company, Cincinnati, Ohio

[21] Appl. No.: 380,115

[22] Filed: Jan. 30, 1995

[51] Int. Cl.[6] ..... B26B 1/08

[52] U.S. Cl. ..... 30/162; 30/335

[58] Field of Search ..... 30/162, 335, 151, 30/320, 329

[56] References Cited

U.S. PATENT DOCUMENTS

| | | | |
|---|---|---|---|
| D. 336,029 | 6/1993 | Ragland et al. . | |
| 3,107,426 | 10/1963 | Robinson, Jr. . | |
| 3,577,637 | 5/1971 | Braginetz . | |
| 3,708,881 | 1/1973 | Bennett | 30/335 X |
| 3,872,591 | 3/1975 | Quenot . | |
| 4,242,795 | 1/1981 | Rollband et al. . | |
| 4,509,260 | 4/1985 | Gringer | 30/162 |
| 4,586,256 | 5/1986 | Weimann . | |
| 4,663,845 | 5/1987 | Weimann . | |
| 5,406,707 | 4/1995 | Owens et al. | 30/162 |

*Primary Examiner*—Hwei-Siu Payer

*Attorney, Agent, or Firm*—Killworth, Gottman, Hagan & Schaeff

[57] ABSTRACT

A utility knife is provided which includes a unitary, blade carrier which acts to restrain the blade during heavy use and which prevents the blade from disengaging from the knife. The blade carrier includes a blade support portion, a blade retaining flange for retaining a first edge of the blade, and at least one laterally extending post for receiving a corresponding notch or notches in the blade when the blade is mounted on the blade carrier. The post has a profile which engages the notch in the blade when the blade is subjected to a lateral or twisting force to prevent the blade from disengaging from the blade carrier during use. In this manner, the post on the blade carrier performs the dual function of providing both longitudinal as well as lateral restraint for the blade.

11 Claims, 3 Drawing Sheets

UTILITY KNIFE HAVING BLADE RETENTION FEATURE

BACKGROUND OF THE INVENTION

The present invention relates to utility knives having replaceable blades, and more particularly to a utility knife which includes a blade retention feature to prevent the blade from releasing from the knife during use.

Utility knives having replaceable blades and with a variety of end uses are well known in the art. Exemplary of such utility knives are U.S. Pat. Nos. 3,107,426, 3,872,591, 3,577,637, 4,242,795, 4,586,256, and 4,663,845. Such knives incorporate a blade carrier which mounts and supports a blade in the interior of the knife handle. Typically, the blade will include one or more notches on an upper edge which seat against one or more laterally extending posts or lugs on the blade carrier to restrain the blade from longitudinal movement. The blade carrier may also incorporate a thumb actuated button that is depressed to unlatch the blade carrier and blade from one of several latched positions and then moved forwardly or rearwardly to extend or retract the blade. The respective knives are adapted so that mounting and replacement of the blades is relatively simple. For example, in many instances, the knife comprises a pair of complementary halves which are held together by a screw or the like. Loosening or removal of the screw permits the knife to be disassembled and the blade accessed.

However, while such knife designs generally operate in an efficient manner, one continuing problem with them has been the tendency of the blades to release or disengage from the blade carrier during heavy use, particularly where strong lateral or twisting forces are imposed on the cutting edge of the blade. The twisting or lateral movement of the blade may cause the nose of the knife to open slightly. This, in turn, may permit the blade to release from the lugs or posts on the blade carrier and the knife handle, resulting in the need to stop using the knife and to reassemble the knife and blade. The release of the blade from the knife during use also potentially poses a safety problem.

Attempts have been made in the art to overcome this problem. One approach is taught in the above-mentioned U.S. Pat. No. 4,586,256, where the blade carrier includes a tab which has an overhanging bearing edge which is spaced from the blade carrier and which captures the blade to retain it against the blade carrier and prevent it from twisting laterally. Another approach is taught in the above-mentioned U.S. Pat. No. 4,663,845, which teaches the use of a retaining tab for the blade on the rear edge of the blade carrier in combination with a protrusion on one of the facing knife halves which together restrain the blade against twisting lateral movement.

However, while the prior art approaches have addressed the problem, the need still exists for a simple solution which permits a knife having the desired blade retention features.

SUMMARY OF THE INVENTION

The present invention meets that need by providing a simple, unitary, blade carrier which acts to retain the blade during heavy use and which prevents the blade from disengaging from the knife. According to one aspect of the present invention, a utility knife having a replaceable blade is provided and includes a pair of complementary opposing knife handle halves adapted to mate together to form a blade opening at a forward end of the knife. The knife also includes a replaceable blade having one or more locating notches along an edge thereof and a blade carrier adjacent the blade opening which is adapted for mounting the replaceable blade thereon such that the mounted blade extends through the blade opening and presents a cutting edge. The blade carrier includes a blade support portion, a blade retaining flange for retaining a first edge of the blade, and at least one laterally extending post for receiving the notch or notches in the blade when the blade is mounted on the blade carrier. At least one of the posts has a profile which engages a respective one of the notches in the blade when the blade is subjected to a lateral or twisting force to prevent the blade from disengaging from the blade carrier during use. In this manner, the posts on the blade carrier perform the dual function of providing both longitudinal as well as lateral restraint for the blade.

In a preferred embodiment of the invention, the profile of the post increases in thickness along its length. While the increase in thickness need not be uniform or continuous, at some point along the length of the post, the profile increases so that it becomes greater in cross-section than the opening of the notch on the blade. That is, if one were to view horizontal cross-sections of the profile taken from points along its length as it extends from the blade carrier, at some point those cross-sections would increase in area as one moved upwardly away from the blade carrier. Other embodiments of the invention include variations on this basic concept. For example, it is preferred that there be a pair of posts and that both of the posts have profiles which will engage respective ones of the notches if the blade is subjected to lateral or twisting forces. The increase in the thickness of the profiles may be along facing sides of the profiles, opposing sides of the profiles, or along the rearwardly facing sides of the profiles.

While the invention is useful for fixed, nonretractable knives, it is particularly useful where the opposing knife handles include a guide, and the blade carrier is mounted for selective longitudinal movement along the guide to provide at least a retracted, sheathed position for the blade and an extended, unsheathed position for the blade. To provide a simple yet inexpensive part, the blade carrier, the blade support portion, the blade retaining flange, and the posts are cast as an integral, unitary part.

In another embodiment of the invention, the laterally extending posts for receiving the notches in the blade have an extended length. Thus, at least one of the posts has a length sufficient to engage a respective one of the notches in the blade when the blade is subjected to a lateral or twisting force to prevent the blade from disengaging from the blade carrier during use. Generally, the posts are spaced apart along an edge of the blade carrier opposite the blade retaining flange, and the post which is farther from the blade opening is longer than the other post. The shorter post may have a beveled leading edge so that when the blade carrier is moved to an extended cutting position for the blade, the posts will clear the interior of the opposite half of the knife as it tapers toward the forward blade opening.

Accordingly, it is a feature of the present invention to provide a simple, unitary, blade carrier which acts to retain the blade during heavy use and which prevents the blade from disengaging from the blade carrier and knife handle. This, and other features and advantages of the invention, will become apparent from the following detailed description, the accompanying drawings, and the appended claims.

DETAILED DESCRIPTION OF THE PREFERRED EMBODIMENTS

Figure 1:
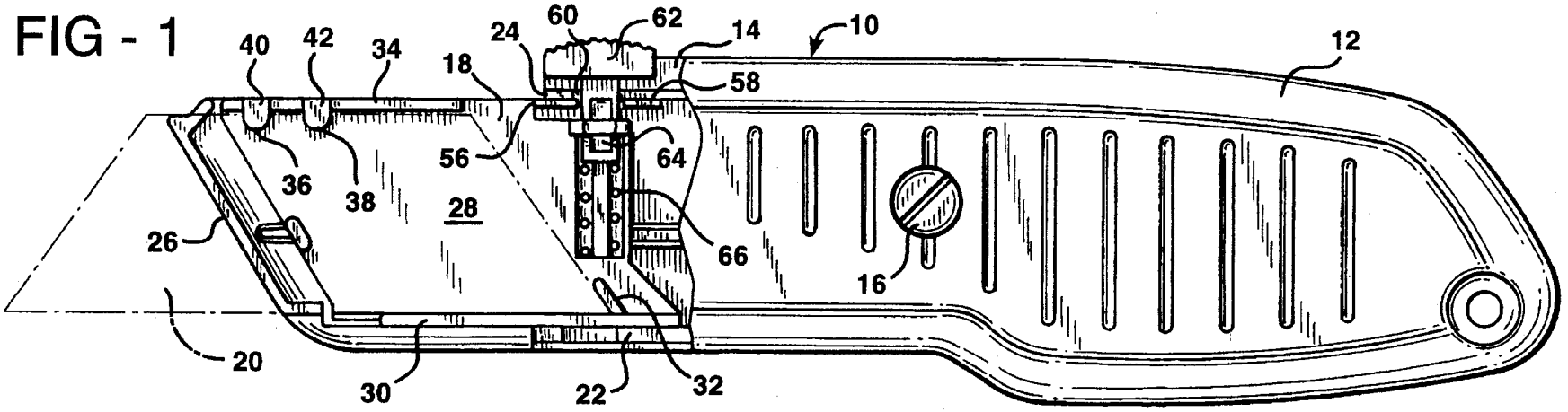
FIG. 1 is a side elevational view of the knife, partially cut away to reveal the blade and retractor mechanism and blade-retaining posts, in a preferred embodiment.

Referring now to FIG. 1, the utility knife of the present invention is depicted in a preferred embodiment wherein the knife includes a retractable blade having a trapezoidal shape. However, it will be apparent to those skilled in this art that the invention also has applicability to non-retractable, fixed-blade knives as well. Further, the blade may take a number of forms including the shape illustrated, a hook blade, a scoring blade, or any other form of blade which can be adapted for mounting to the blade carrier.

As shown, knife 10 comprises a pair of complementary, mating and opposing knife halves 12 and 14 which are assembled using screw 16 to form an exterior profile which is easy to grip in the hand of a user. The mating knife halves 12 and 14 form a hollow interior which provides space for the blade carrier 18 and blade 20 (shown in phantom lines) to reside. As explained in greater detail below, knife 10 may include the optional feature of a retractable blade. Where blade retractability is desired, within the interior of knife halves 12 and 14 are spaced, substantially parallel guides 22 and 24 between which blade carrier 18 is mounted for linear longitudinal movement.

Blade 20 is replaceable as is conventional in this art by removing screw 16 and taking apart the knife halves. Knife halves 12 and 14 mate to form a forward blade opening 26 to provide an opening for the blade 20 to be moved longitudinally from a retracted, sheathed position to an extended cutting position (shown). As is also conventional, there may be provided additional intermediate positions for the blade carrier and blade. In describing the knife and its components, the convention which will be used will be to refer to the blade end of the knife as the forward end (left-facing end in FIG. 1).

Blade carrier 18 includes a generally flat blade support portion 28 on which blade 20 rests and a blade retaining flange 30 for retaining one edge of the blade. As shown, blade retaining flange 30 extends at a right angle from blade support portion 28 and rests on guide 22. The cutting edge of blade 20 rests on flange 30. A protruding edge 32 also projects from blade support portion 28 to engage the rear edge of blade 20. As shown, edge 32 is angled to mate with the angle of the rear edge of blade 20.

A second flange 34, extending from blade support portion 28, engages the top edge of blade 20 so that blade 20 fits between the two flanges. Flange 34 rests against guide 24. Blade 20 includes at least one, and preferably two, locating notches 36 and 38 (best seen in FIG. 3) which are sized to fit against posts 40 and 42, respectively. Typically, the notches are semi-circular in shape and mate with the semi-cylindrical shape of the posts. Posts 40 and 42 extend upwardly from blade support portion 28 and terminate at the surface of flange 34. Their rear surfaces are integral with and form a part of flange 34. When blade 20 and notches 36 and 38 are fitted into position to engage posts 40 and 42, blade 20 is restrained from longitudinal movement (i.e., movement to the left or right as shown in FIG. 1) in blade carrier 18. To insert the blade 20 in the blade carrier 18, the upper edge of the blade 20 which has the notches 36 and 38 is held so that it is angled downwardly against blade carrier 18 to mate with the lower portions 44 and 46 of posts 40 and 42. The blade is then allowed to drop into position against carrier 18. To remove the blade, the end of the blade is grasped, and the cutting edge is tilted upwardly until it clears retaining flange 30. The blade is then pulled away from posts 40 and 42.

In the present invention, posts 40 and 42 also perform a second function, that of restraining blade 20 from lateral movement (i.e., movement away from the surface of blade support portion 28) when blade 20 is subjected to lateral (i.e., side-to-side) and/or twisting (i.e., where the top portion of the blade and the cutting edge are subjected to forces in opposite directions) forces. In some prior art knife designs, lateral or twisting forces encountered by the blade during heavy use would cause the blade to move away from the surface of the blade support. The notches in the blade would move upwardly along the posts, and the blade would be released from the lateral restraints of those posts.

The present invention solves that problem by providing one or more posts which have a profile which engages the notch or notches 36 and 38 on blade 20 when the blade is subjected to a lateral or twisting force. In the embodiment shown in FIGS. 2 and 3, where like reference numerals represent like elements, the lower portions 44 and 46 (i.e., those portions nearest the surface of blade support portion 28) of posts 40 and 42 have a generally semi-circular cross-section which mates with semi-circular notches 36 and 38 on blade 20. Those lower portions have a vertical length which is somewhat greater than the thickness of blade 20 to permit easy insertion and withdrawal of the blade during replacement.

However, the upper portions 48 and 50 of posts 40 and 42 have, as shown, an increasingly thickening profile along their respective facing surfaces. This thicker profile results in a cross-section which has a diameter larger than the diameter of notches 36 and 38. While the thickening profile is depicted as a relatively smooth transition between lower and upper portions, it will be apparent that the changing profile need not be continuous or even smooth as long as the profile at some point has a diameter larger than that of the notches on the blade. When blade 20 is subjected to lateral or twisting forces, any lateral movement of the blade is restrained by the frictional engagement of notches 36 and 38 with upper post portions 48 and 50. Thus, the posts perform a second function, that of preventing blade 20 from disengaging from the blade carrier 18 during use of the knife without the need for separate overhanging tabs or flaps on the blade carrier or protrusions on the facing blade half.

Figure 2:
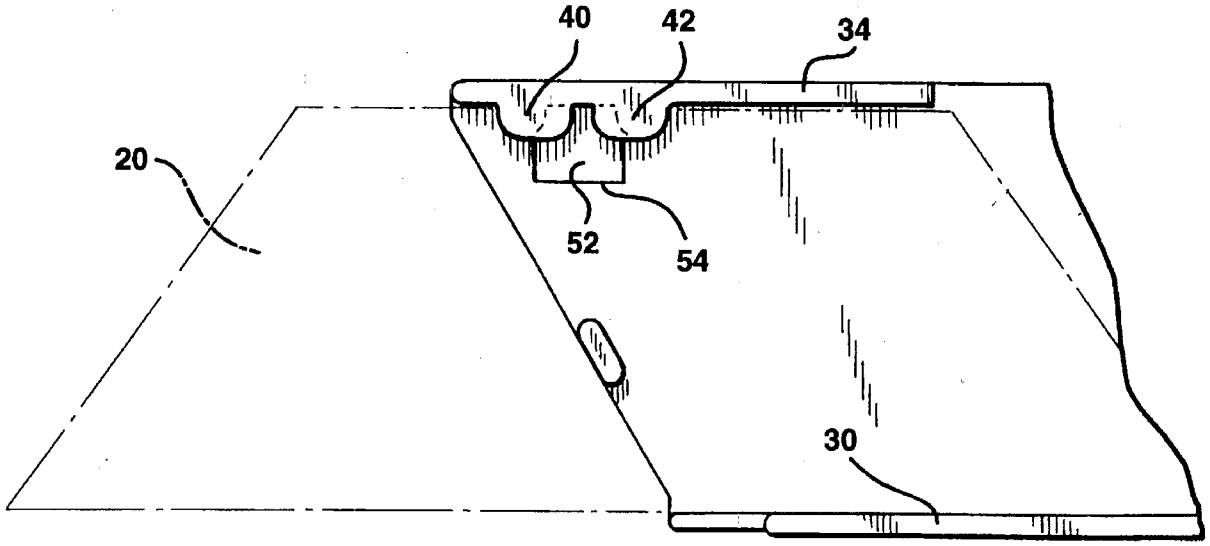
FIG. 2 is an enlarged side elevational view showing another embodiment of the blade-retaining posts.
Figure 3:
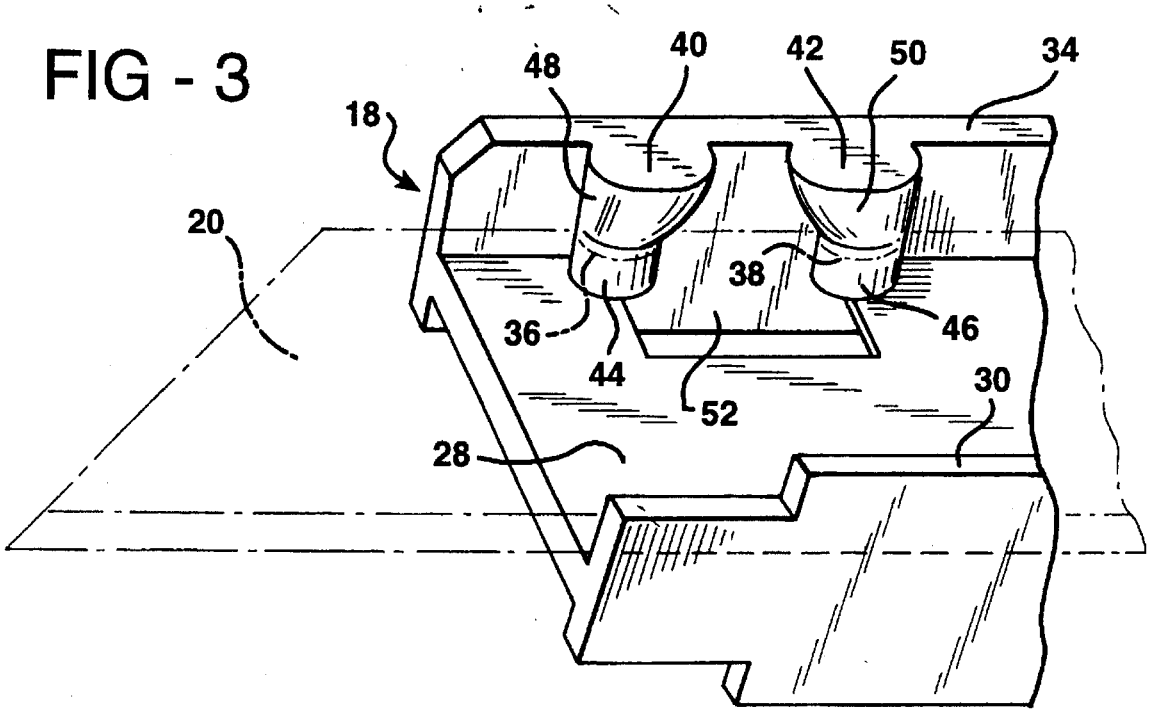
FIGS. 3, 4, and 5, respectively, are perspective views of the blade carrier and additional embodiments of the blade-retaining posts.

In a preferred embodiment of the invention, blade carrier 18, including blade support portion 28, flanges 30 and 34, as well as posts 40 and 42 are all cast as a single, integral construction and may be fabricated from any suitable casting metal such as zinc. As shown in FIGS. 2 and 3, an open area 52 defined by parting line 54 is placed in the casting to permit the increased profile thicknesses in posts 40 and 42 to be cast.

Figure 4:
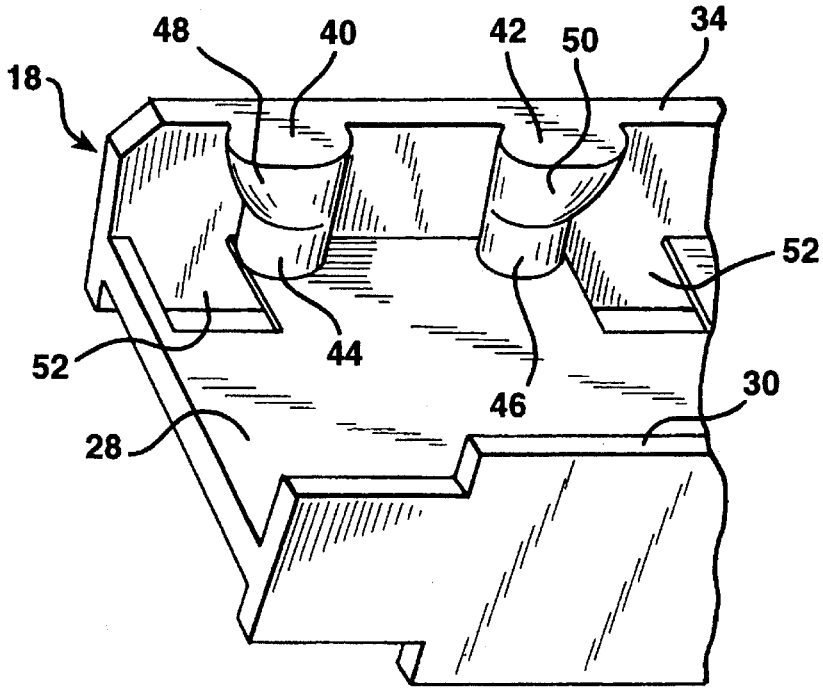
Figure 5:
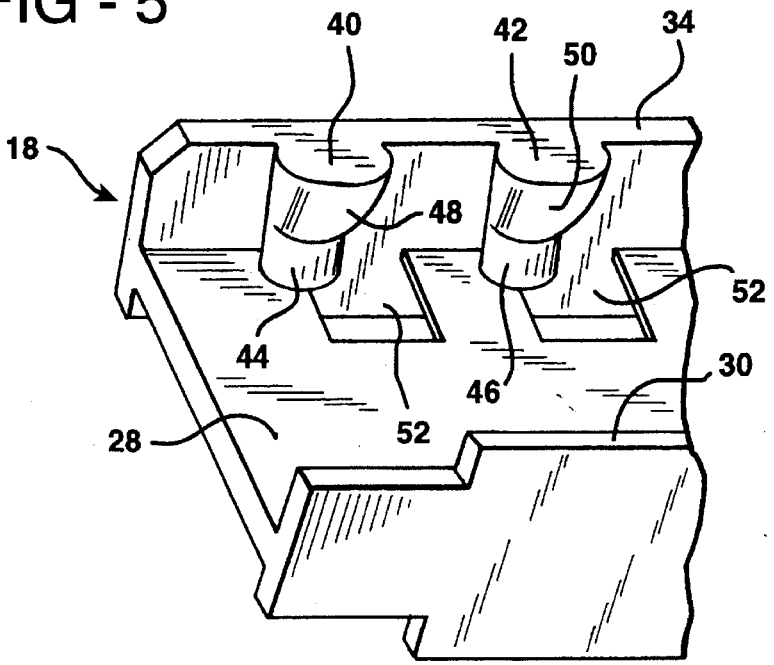

Referring now to FIG. 4, an alternative embodiment of the invention is shown. In this embodiment, the upper portions 48 and 50 of posts 40 and 42 have a thickened profile along opposing faces of the posts. To permit such profiles to be cast, open areas 52 are provided in the surface of blade carrier 18. FIG. 5 shows yet another embodiment of the invention. In this embodiment, the upper portions 48 and 50 of posts 40 and 42 have a thickened profile along the rearward (i.e., facing away from blade opening 26) faces of the posts. Again, to permit such profiles to be cast, open areas 52 are provided in the surface of blade carrier 18.

Figure 6:
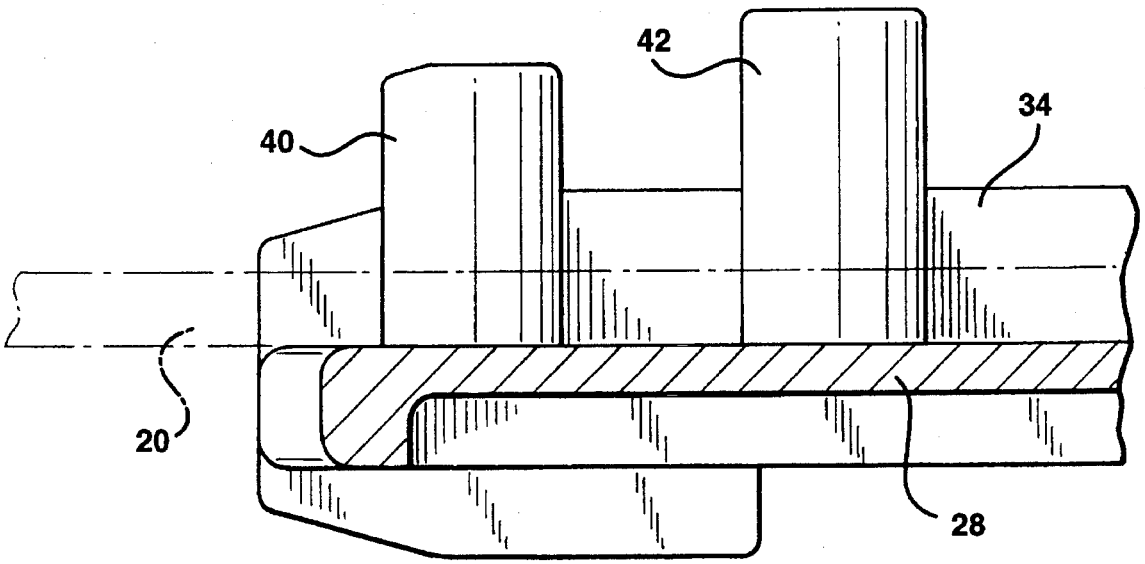
FIG. 6 is an enlarged edge view, in section, illustrating the embodiment of the invention using posts having increased length.

Referring now to FIG. 6, yet another embodiment of the invention is illustrated. In this embodiment, at least post 42 (the more rearward of the two posts) has an increased length which is sufficient to maintain engagement with notch 38 on blade 20 even when blade 20 is subjected to severe lateral or twisting forces. Thus, as shown, posts 40 and 42 have lengths which extend beyond the surface of flange 34 and toward the inwardly facing body of mating knife half 12. Preferably, the posts extend so that they will just clear the inwardly facing body of knife half 12. Where a retractable blade is provided, post 40 has a somewhat shorter length than post 42 and may have a beveled leading edge as shown so that when the blade carrier is moved to an extended cutting position for the blade, posts 40 and 42 will clear the interior of the opposite half of the knife as it tapers toward forward blade opening 26. While it will be apparent that the exact lengths of the posts will differ depending upon the size and shape of the knife and blade carrier, in one example post 42 has a length of 0.245 inches, and post 40 has a length of 0.209 inches with a bevel angle of 15° for the leading edge.

Referring back now to FIG. 1, an optional feature of the present invention is to provide a retractable blade for the knife. As shown, guide 24 includes beneath it a series of lands 56 and 58 having notches, such as notch 60 therebetween. A thumb button 62 is connected to a latch 64 which extends into notch 60. A coil spring 66, restrained in blade carrier 18, normally biases latch 64 into notch 60 to prevent longitudinal movement of blade carrier 18 and blade 20. However, when thumb button 62 is depressed by the knife operator, latch 64 is also depressed so that it clears notch 60. By pushing thumb button 62 longitudinally when depressed, blade 20 is released for longitudinal movement as blade carrier 18 moves along guides 22 and 24, such as from a retracted position to an extended cutting position.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A utility knife having a replaceable blade comprising:

a) a pair of complementary opposing knife handle halves adapted to mate together to form a blade opening at a forward end of the knife;

b) a replaceable blade including at least one locating notch along an edge thereof; and c) a blade carrier adjacent said blade opening adapted for mounting said replaceable blade thereon such that the mounted blade extends through said blade opening and presents a cutting edge, said blade carrier including a blade support portion, a blade retaining flange for retaining a first edge of said blade, and an least one laterally extending post for receiving said notch in said blade when said blade is mounted on said blade carrier, said at least one post having a profile which increases in thickness along its length and which engages said notch in said blade when said blade is subjected to a lateral or twisting force to prevent said blade from disengaging from said blade carrier during use.

2. A utility knife as claimed in claim 1 in which said at least one locating notch includes a plurality of locating notches and said at least one post includes a pair of posts in which both of said posts have profiles which engage respective ones of said notches.

3. A utility knife as claimed in claim 2 in which facing sides of said profiles increase in thickness along their respective lengths.

4. A utility knife as claimed in claim 2 in which opposing sides of said profiles increase in thickness along their respective lengths.

5. A utility knife as claimed in claim 2 in which the rearwardly facing sides of said profiles increase in thickness along their respective lengths.

6. A utility knife as claimed in claim 2 in which said blade support portion, said blade retaining flange, and said posts are cast as an integral, unitary part.

7. A utility knife as claimed in claim 1 in which said opposing knife handle halves include a guide and said blade carrier is mounted for selective longitudinal movement along said guide to provide a retracted, sheathed position for said blade and an extended, unsheathed position for said blade.

8. A utility knife as claimed in claim 1 in which said blade support portion, said blade retaining flange, and said at least one post are cast as an integral, unitary part.

9. A utility knife having a replaceable blade comprising:

a) a pair of complementary opposing knife handle halves adapted to mate together to form a blade opening at a forward end of the knife;

b) a replaceable blade including a plurality of locating notches along an edge thereof; and c) a blade carrier adjacent said blade opening adapted for mounting said replaceable blade thereon such that the mounted blade extends through said blade opening and presents a cutting edge, said blade carrier including a blade support portion, a blade retaining flange for retaining a first edge of said blade, and a pair of laterally extending posts for receiving said notches in said blade when said blade is mounted on said blade carrier, the post which is farther from said blade opening being longer than the other post, said pair of posts having a length sufficient to engage said notches in said blade when said blade is subjected to a lateral or twisting force to prevent said blade from disengaging from said blade carrier during use.

10. A utility knife as claimed in claim 9 in which the shorter post has a beveled leading edge.

11. A utility knife as claimed in claim 9 in which said opposing knife handle halves include a guide and said blade carrier is mounted for selective longitudinal movement along said guide to provide a retracted, sheathed position for said blade and an extended, unsheathed position for said blade.

* * * * *